US005642144A

United States Patent [19]

Plotkin

[11] Patent Number: 5,642,144

[45] Date of Patent: Jun. 24, 1997

[54] RECHARGEABLE PEN FOR PRINTER

[75] Inventor: Lawrence R. Plotkin, Corvallis, Oreg.

[73] Assignee: Hewlett-Packard Company, Palo Alto, Calif.

[21] Appl. No.: 346,117

[22] Filed: Nov. 29, 1994

[51] Int. Cl.[6] ..... B41J 2/175

[52] U.S. Cl. ..... 347/87

[58] Field of Search ..... 347/85–87

[56] References Cited

U.S. PATENT DOCUMENTS

| | | | |
|---|---|---|---|
| 4,217,058 | 8/1980 | Straszewski et al. | 401/135 |
| 4,306,245 | 12/1981 | Kasugayama et al. . | |
| 4,329,698 | 5/1982 | Smith . | |
| 4,368,478 | 1/1983 | Kote . | |
| 4,412,232 | 10/1983 | Weber et al. . | |
| 4,419,678 | 12/1983 | Kasugayama et al. . | |
| 4,500,895 | 2/1985 | Buck et al. . | |
| 4,511,678 | 4/1985 | Mahnke et al. . | |
| 4,749,291 | 6/1988 | Kobayashi et al. . | |
| 4,771,295 | 9/1988 | Baker et al. . | |
| 4,794,409 | 12/1988 | Cowger et al. . | |
| 4,929,969 | 5/1990 | Morris . | |
| 4,931,811 | 6/1990 | Cowger et al. . | |
| 4,963,189 | 10/1990 | Hindagolla | 106/22 |
| 5,153,612 | 10/1992 | Dunn et al. . | |
| 5,329,294 | 7/1994 | Ontawar et al. | 397/87 |

FOREIGN PATENT DOCUMENTS

| | | | |
|---|---|---|---|
| 0139508 | 5/1985 | European Pat. Off. . | |
| 0408241 | 1/1991 | European Pat. Off. . | |
| 529879A1 | 3/1996 | European Pat. Off. | 347/87 |
| 6-238909A | 8/1994 | Japan | 347/86 |

OTHER PUBLICATIONS

*Hewlett–Packard Journal*, vol. 36, No. 5 (May 1985).

*IBM Technical Disclosure Bulletin*, (vol. 34, No. 1, Jun. 1991), pp. 459–462.

Information sheet entitled, "Pelikan Hardcopy", The Pelikan Company.

*Primary Examiner*—Benjamin R. Fuller

*Assistant Examiner*—Judy Nguyen

[57] ABSTRACT

The ink supply is contained in a manner that permits quick attachment to and removal from a base part of the pen that carries the print head. The system provides for several re-uses of the base and print head, and a pen recharging technique that can be carried out quickly, without spills, and without otherwise affecting the performance of the print head.

14 Claims, 1 Drawing Sheet

RECHARGEABLE PEN FOR PRINTER

BACKGROUND INFORMATION

This invention pertains to a printer pen that can be recharged after the ink supply is depleted.

Certain ink-jet type printers, including those sold under the designation "DeskJet" by Hewlett-Packard Company of Palo Alto, Calif., use replaceable pens that carry an ink supply. A print head is attached to the pen body. The print head is operable for ejecting minute ink drops through orifices in the print head in a controlled manner while the pen is scanned across paper, thereby to produce the desired images or text.

The supply or reservoir portion of the pen contains reticulated polyurethane foam for storing the ink. The capillarity of the foam provides the necessary back pressure at the print head of the pen to prevent ink from leaking from the pen when the print head is not operated.

In the past, empty pens have not been refilled, even though such pens were otherwise fully functional. Instead, empty pens were disposed of and replaced with new, filled pens. Adding more ink to the foam material is difficult for a user who lacks the appropriate tools such as, for example, needles for injecting the ink under pressure into the foam. If a pen is to be refilled, it is important that a refill process take place relatively quickly so that the print head orifices do not become blocked with dried ink as a result of a lengthy refilling process.

SUMMARY OF THE INVENTION

This invention is directed to a system for quickly and easily recharging a printer pen that contains a supply of ink in foam material stored in the pen. The system provides for the quick replacement of a depleted ink supply cartridge with a filled one, thereby avoiding the problem of having the print head orifices become dry and blocked. The same print head of a particular pen, therefore, may be used with very many supply cartridges.

DETAILED DESCRIPTION OF A PREFERRED EMBODIMENT

Figure 1:
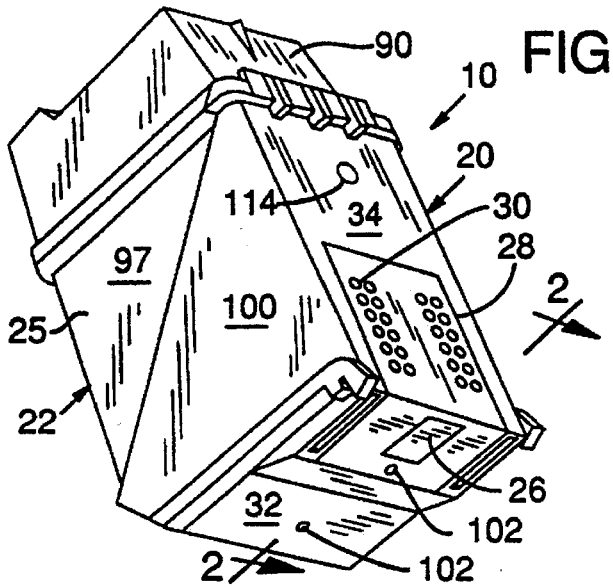
FIG. 1 is a perspective view of a rechargeable pen made in accordance with the present invention.

A rechargeable pen 10 formed in accordance with the present invention (FIGS. 1 and 2) may be installed in the carriage of a printer. An exemplary printer may be one of the DeskJet printer series manufactured by Hewlett-Packard Co. The pen 10 includes a base 20 that engages with a cartridge 22 that houses the ink supply for the pen. An empty pen is recharged by replacing the empty cartridge 22 with a filled one.

More particularly, the pen base 20 has mounted on its underside a print head 26 that includes a plurality of small orifices (not shown) that are shaped as nozzles. Ink drops are projected through the nozzles to form characters or other information on the paper that is advanced through the printer. Whenever the pen 10 is installed in the printer carriage, the print head 26 is held at a predetermined position relative to the printer carriage above the paper that moves through the printer. As is known in the art, each nozzle of the print head has associated with it a thin-film resistor that is selectively driven (heated) with sufficient current for vaporizing ink in the vicinity of the nozzle. The consequent expansion of the heated ink forces a drop of ink through the nozzle.

Conductive lines to each nozzle resistor are carried upon a flexible circuit 28 that is mounted to the bottom wall 32 and front wall 34 of the pen base 20. Circuit contact pads 30 (shown enlarged for illustration) at the end of each resistor drive line connect with small pads that are carried on a corresponding circuit that is mounted to the carriage. The signals for firing the nozzle resistors are generated by a microprocessor and associated drivers that apply the firing signals to the resistor drive lines.

The base 20 and cartridge are, preferably, made from an injection-molded plastic, such as polysulfone. A generally cylindrical tubular member 40 is integrally formed with the bottom wall 32 of the pen base 20. The inner end 44 of the tubular member 40 protrudes upwardly from the base wall 32. The uppermost end 44 of the tubular member 40 is covered with a fine-mesh screen 46 that is heat-staked to the tubular member end 44. The lower end 52 of the tubular member is in fluid communication with an internal conduit 50 that extends between the lower end 52 of the tubular member 40 and the print head 26. The internal conduit 50 may be constructed by heat-welding together two correspondingly grooved plates, the combined plates forming the conduit and bottom wall 32 of the pen base 20.

The screen 46 is liquid permeable, but is sufficiently fine meshed to prevent air bubbles or impurities from passing through it. Ink is drawn from the foam-filled cartridge 22 (described below) through the screen, tubular member 40, and conduit 50 as an operating print head 26 ejects ink from the nozzles.

Figure 2:
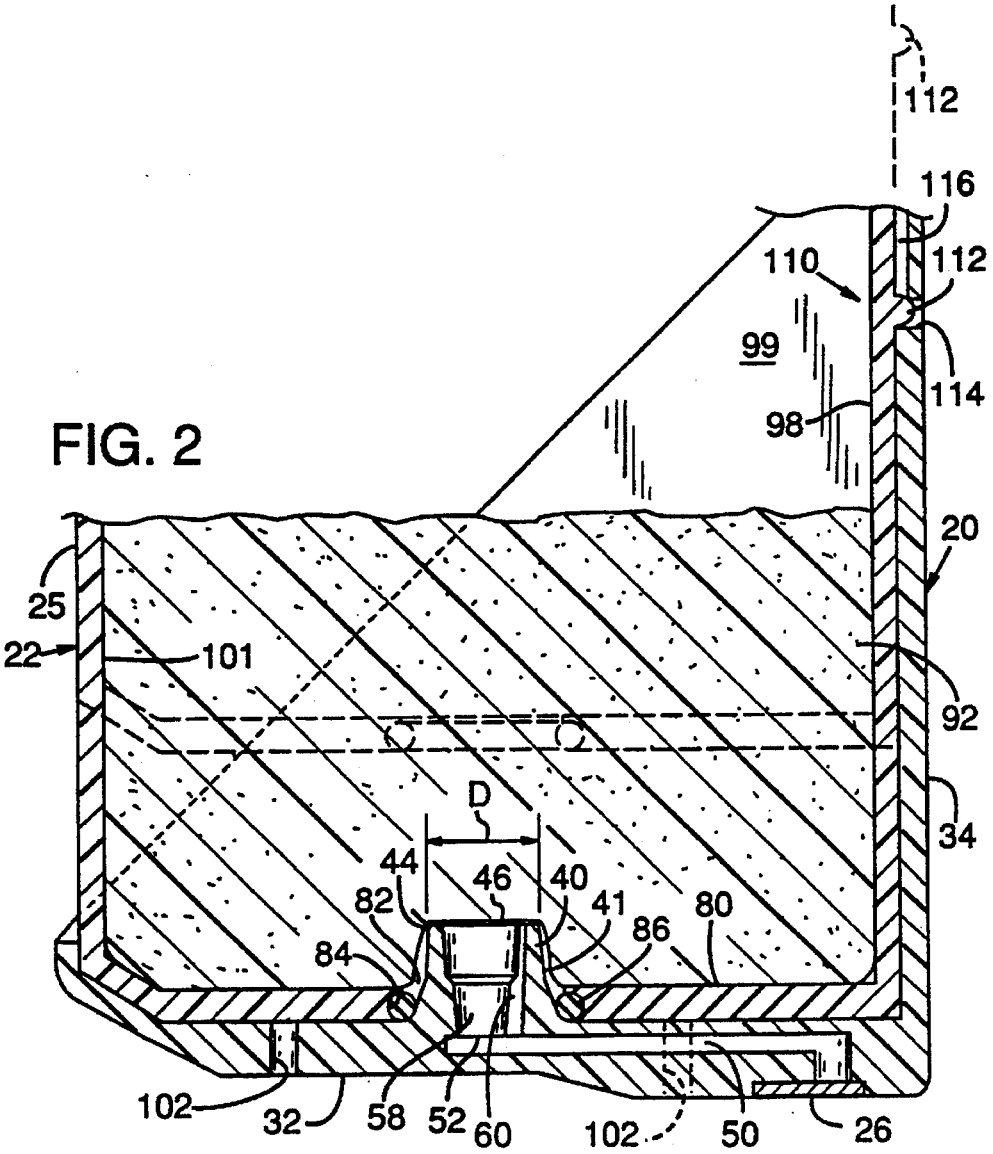
FIG. 2 is a cross-sectional view of the pen of FIG. 1.

In a preferred embodiment, the interior passage 58 defined by the tubular member includes a pair of spaced apart vertical grooves 60 (one shown in FIG. 2). The grooves 60 provide a continuous path for ink adjacent to the passage 58. The grooves are sized small enough so that any air bubbles that may enter the passage 58 will not extend into the grooves to block the flow of ink through the grooves. Accordingly, the grooves 60 provide an uninterruptable fluid path of ink through the tubular member.

The pen cartridge 22 generally comprises a case 25 that encases reticulated polyurethane foam 92 that is initially saturated with ink. In the bottom 80 of the case 25 there is formed a circular opening 82 that is defined by concave edges 84. The opening 82 receives and holds an 0-ring 86. Preferably, the opening of a filled cartridge is covered with an adhesive tape seal (not shown) that serves as a protective cover and is removed just before the cartridge is to be attached to a pen base.

The top case 25 carries a cap 90 that has a port formed therethrough for providing fluid communication between the interior of the case and ambient air.

The dimensions of the cartridge 22 and base 20 are such that the two components are easily engaged and separated. As best shown in FIG. 2, the bottom 80 of the case 25 fits against the bottom wall 32 of the base. The front side wall 98 of the case fits snugly against the inner surface of the front wall 34 of the base. The side walls 97 (FIG. 1) and 99 (FIG. 2) of the case fit between the opposing side walls 100 of the base (only one side wall 100 shown in FIG. 1).

Preferably, the tubular member 40 and the opening 82 in the bottom 80 of the case 25 are arranged such that when the case and the base are engaged, the upper end 44 of the tubular member protrudes through the hole 82 in the case by an amount sufficient to compress the foam 92 in the vicinity of the tubular member against the screen 46 so that no air is able to become trapped between the foam and the screen 46. Such trapping of air would interfere with flow of ink from the foam into the tubular member.

It has been found that generally uniform compression of the foam over the complete surface area of the screen 46 (hence, assurance that no air will reside between the foam and the screen) occurs when the tubular member 40 is sufficiently spaced from each side wall (97, 98, 99, 101) of the case. The effect of spacing the tubular member 40 from the side walls permits the foam 92 to compress over the entire upper surface 46 of the screen in that the foam over and beneath the screen substantially surrounds the external surface 41 of the inner end 44 of the tubular member.

Preferably, the tubular member 40 is spaced from the nearest side wall by a distance corresponding to one external diameter ("D" in FIG. 2) of the tubular member inner end 44. Such spacing ensures the foam compression just described.

The above-mentioned 0-ring 86 fits snugly against the exterior surface 41 of the tubular member 40 when the pen case 25 and base 20 are engaged. The O-ring 86 serves to prevent air from moving between the case 25 and the tubular member 40 toward the screen. In a preferred embodiment, the exterior surface 41 of the tubular member 40 is tapered in a manner such that the overall diameter of the tubular member increases somewhat steeply at the junction of the tubular member 40 and bottom wall 32. As the case 25 is brought in complete engagement with the base 20 (that is, with the case bottom 80 is immediately adjacent the base bottom wall 32) the 0-ring 86 will be squeezed into a tight seal.

Vents 102 are provided in the wall 32 of the pen base 20. In the embodiment shown in FIGS. 1 and 2, two apertures are employed as vents 102, although any number or size of openings may be used. The vents permit the escape of air, which air might otherwise be trapped between the case and base, when the case 25 is brought into engagement with the base 20. In the absence of such vents, there is a likelihood that engagement of the case would compress the air between the bottom 80 and wall 32 and force air into the passage 58 of the tubular member, which would result in an unwanted pumping (leaking) of ink through the print head 26. Similarly, vents 102 permit air to enter the space between the walls 80, 32, whenever the cartridge 22 is removed, thereby preventing the build-up of a suction force between the walls 80, 32, which suction could have the undesirable effect of drawing ink out of the base tubular member 40 or case opening 82.

In a preferred embodiment, the case 25 is retained in engagement with the base 20 (FIG. 2) by a retainer mechanism 110. The retainer mechanism comprises a dimple 112 formed to protrude from the outer surface of the front side wall 98 of the case 25. The dimple fits within a hole 114 formed in the wall 34 of the pen base 20 whenever the case and base are properly engaged. Preferably, a groove 116 is formed in the inner surface of the side wall 34 to extend upwardly from and contiguous with the hole 114. The groove 116 serves as a guide for receiving the dimple 112 and directing it into the hole 114 as the case 25 is moved into engagement with the base 20. It will be appreciated by one of ordinary skill that any of a number of retaining means can be employed for the purpose of retaining the case and base in engagement.

Whenever the pen cartridge 22 is emptied, the empty cartridge 22 is lifted, such as by grasping the cap 90, away from the base (note dashed lines in FIG. 2). The adhesive tape that covers the orifice 82 of a new, filled cartridge is removed, and that cartridge is installed by pushing the cartridge and base toward one another until the retainer mechanism snaps together.

Although the foregoing invention has been described in connection with preferred and alternative embodiments, it will be appreciated by one of ordinary skill that various modifications and variations may be substituted for the mechanisms and method described here while the invention remains defined by the appended claims and their equivalents.

The invention claimed is:

1. A pen for a printer, comprising:

a base having a print head attached thereto;

a tubular member attached to the base, the tubular member having an inner end protruding from the base;

a conduit defined by the base for connecting the tubular member in fluid communication with the print head;

a cartridge shaped to removably engage the base, the cartridge including a case in which is stored an ink supply, the case having an opening formed therein, the inner end of the tubular member fitting into the opening as the cartridge is moved into engagement with the base, thereby to place the tubular member and print head in fluid communication with the ink supply carried within the cartridge; and a vent formed in the base for venting, through the vent, air that is displaced as a result of the movement of the cartridge into and out of engagement with the base.

2. The pen of claim 1 including a resilient sealing ring attached to the case to surround the opening for sealing the tubular member against the case opening.

3. The pen of claim 2 wherein the tubular member has a tapered exterior surface for increasingly compressing the sealing ring as the cartridge is moved into engagement with the base.

4. The pen of claim 1 wherein the inner end of the tubular member has an external diameter and wherein the case has side walls between which the tubular member protrudes when the cartridge is engaged with the base, the tubular member being located at least about a distance of said external diameter from each of said side walls when the cartridge is engaged with the base.

5. The pen of claim 1 further comprising retainer means for releasably retaining the cartridge in engagement with the base.

6. The pen of claim 1 in which the base is shaped to have an interior surface and an exterior surface and in which the vent extends through the base from the interior surface to the exterior surface.

7. A pen for a printer comprising:

a base having a print head attached thereto and having a bottom wall;

a tubular member in the bottom wall, the tubular member having an internal passage, the tubular member including an inner end having an external surface and protruding outwardly from the base, the tubular member having a screen attached to the inner end;

a conduit defined in the bottom wall for connecting the passage of the tubular member in fluid communication with the print head;

an ink-supply cartridge configured to removably engage the base, the cartridge including a case in which is stored foam that carries an ink supply, the case having side walls and a bottom and an opening formed in the bottom, the inner end of the tubular member fitting within the opening to compress the foam against the screen as the cartridge is moved into engagement with the base;

the opening of the case being located on the bottom such that when the case is inserted in the base, the foam substantially surrounds the external surface of the inner end of the tubular member when the cartridge is engaged with the base; and vent means for venting air that is displaced as a result of the movement of the cartridge into and out of engagement with the base.

8. The pen of claim 7 wherein the bottom of the case carries a compressible seal surrounding the opening and wherein the tubular member has a tapered exterior surface for increasingly compressing the seal as the cartridge is moved into engagement with the base, thereby sealing the tubular member against the case opening.

9. The pen of claim 7 further comprising first and second retainer members respectively carried by the cartridge and the base, the retainer members releasably locking together as the cartridge is moved into engagement with the base, thereby retaining the cartridge in engagement with the base.

10. A pen for a printer comprising;

a base having a print head attached thereto;

a tubular member in the base, the tubular member having an inner end protruding from the base, the inner end having an external surface;

a conduit defined by the base for connecting the tubular member in fluid communication with the print head;

an ink-supply cartridge shaped to removably engage the base, the cartridge including a case for storing an ink supply, the case containing foam and having side walls and an opening formed in the case, the inner end of the tubular member fitting into the opening to protrude between the side walls as the cartridge is moved into engagement with the base, thereby to place the tubular member and print head in fluid communication with the ink supply carried within the cartridge;

wherein the tubular member is spaced from each of said side walls when the cartridge is engaged with the base a distance sufficient to permit the foam to substantially surround the external surface of the inner end of the tubular member; and vent means for venting air that is displaced as a result of the movement of the cartridge into and out of engagement with the base.

11. The pen of claim 10 wherein the case carries a compressible seal surrounding the opening and wherein the tubular member has a tapered exterior surface for increasingly compressing the seal as the cartridge is moved into engagement with the base, thereby sealing the tubular member against the casing opening.

12. The pen of claim 10 further comprising retainer means for releasably retaining the cartridge in engagement with the base.

13. The pen of claim 10 in which the tubular member is offset from the print head.

14. The pen of claim 10 in which the tubular member has an external diameter and the tubular member is spaced at least about a distance of said external diameter from each of said side walls to facilitate foam compression around the tubular member.

* * * * *